US011534636B2

(12) United States Patent
Fazzio

(10) Patent No.: US 11,534,636 B2
(45) Date of Patent: Dec. 27, 2022

(54) FIRE EXTINGUISHERS WITH INVERTED INTERNAL DOMES

(71) Applicant: Kidde Technologies, Inc., Wilson, NC (US)

(72) Inventor: Mark P. Fazzio, Wilson, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 0 days.

(21) Appl. No.: 15/650,036

(22) Filed: Jul. 14, 2017

(65) Prior Publication Data

US 2019/0015690 A1 Jan. 17, 2019

(51) Int. Cl.

| | |
|---|---|
| ***A62C 13/00*** | (2006.01) |
| ***A62C 13/62*** | (2006.01) |
| ***A62C 35/02*** | (2006.01) |
| ***A62C 3/08*** | (2006.01) |
| ***A62C 11/00*** | (2006.01) |

(52) U.S. Cl.

CPC ..... *A62C 13/003* (2013.01); *A62C 3/08* (2013.01); *A62C 11/00* (2013.01); *A62C 13/00* (2013.01); *A62C 13/62* (2013.01); *A62C 35/023* (2013.01)

(58) Field of Classification Search

CPC ..... A62C 13/003; A62C 13/62; A62C 13/00; A62C 13/02; A62C 13/20; A62C 13/22; A62C 3/08; A62C 31/005; A62C 31/02; A62C 31/22; A62C 31/05; A62C 13/64; A62C 13/66; A62C 13/68; A62C 13/70; A62C 11/005; A62C 11/00; B64D 37/32; B64D 2045/009

USPC ..... 169/62, 71, 72, 30, 91, 46

See application file for complete search history.

(56) References Cited

U.S. PATENT DOCUMENTS

| | | | | |
|---|---|---|---|---|
| 147,681 A * | 2/1874 | Parker | A62C 31/02 | 169/37 |
| 578,434 A * | 3/1897 | White | A62C 13/003 | 169/74 |
| 811,211 A * | 1/1906 | Hildebrand | A63G 25/00 | 104/68 |
| 2,404,777 A * | 7/1946 | Gaines | A62C 13/003 | 292/256.67 |

(Continued)

FOREIGN PATENT DOCUMENTS

| | | |
|---|---|---|
| DE | 4440155 A1 | 5/1996 |
| FR | 2076336 A5 | 10/1971 |

OTHER PUBLICATIONS

"Axial." Merriam-Webster.com. 2021. https://www.merriam-webster.com/dictionary/axial (Mar. 18, 2021). (Year: 2021).*

(Continued)

*Primary Examiner* — Christopher R Dandridge

(74) *Attorney, Agent, or Firm* — Locke Lord LLP; Joshua L. Jones; Gabrielle Gelozin

(57) ABSTRACT

A fire extinguisher includes a main dome partially surrounding an internal space housing agent. A secondary dome is mounted to the main dome and is inverted with respect to the main dome. The secondary dome can have a radius of curvature that is equal to, greater than, or less than that of the main dome. The discharge outlet can include a discharge outlet configured to discharge laterally relative to an axis of symmetry of the main dome and the secondary dome.

17 Claims, 2 Drawing Sheets

(56) References Cited

U.S. PATENT DOCUMENTS

| | | | | |
|---|---|---|---|---|
| 2,730,180 | A * | 1/1956 | Beard, Jr. | A62C 13/003 141/20 |
| 3,965,988 | A | 6/1976 | Wesson et al. | |
| 4,285,403 | A | 8/1981 | Poland | |
| 4,328,867 | A | 5/1982 | Heath | |
| 6,053,256 | A * | 4/2000 | Lu | A62C 35/13 137/513.3 |
| 6,513,602 | B1 * | 2/2003 | Lewis | A62C 5/006 169/84 |
| 6,561,281 | B1 * | 5/2003 | Arnold | A62C 13/00 169/43 |
| 8,220,764 | B2 * | 7/2012 | Ziaylek | A62B 25/00 248/312 |
| 8,672,044 | B2 | 3/2014 | Fabre | |
| 8,800,675 | B2 | 8/2014 | Machado et al. | |
| 2007/0007019 | A1 | 1/2007 | Wierenga et al. | |
| 2007/0158085 | A1 | 7/2007 | Bourdet et al. | |
| 2008/0289832 | A1 | 11/2008 | Schimpf et al. | |
| 2013/0220651 | A1 * | 8/2013 | Rachidi | A62C 13/66 169/85 |
| 2016/0325129 | A1 | 11/2016 | Jordan et al. | |

OTHER PUBLICATIONS

Extended European Search Report dated Dec. 17, 2018. issued during the prosecution of European Patent Application No. 18183540. 6, 8 pages.

* cited by examiner

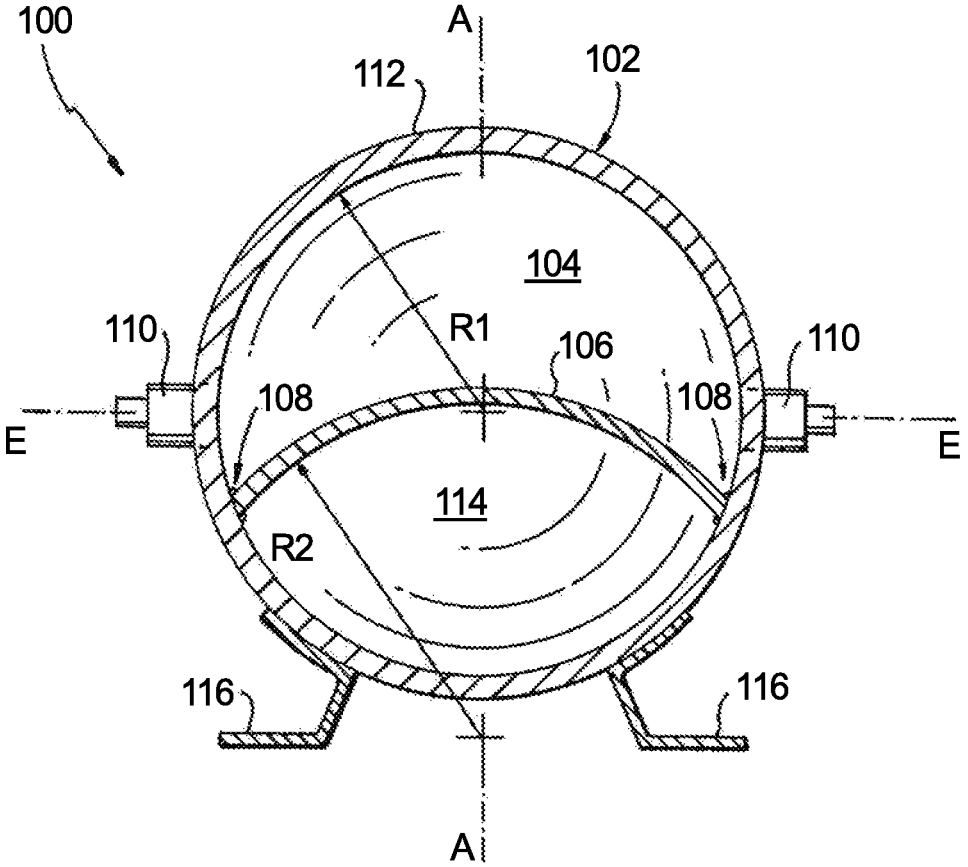
Fig. 1
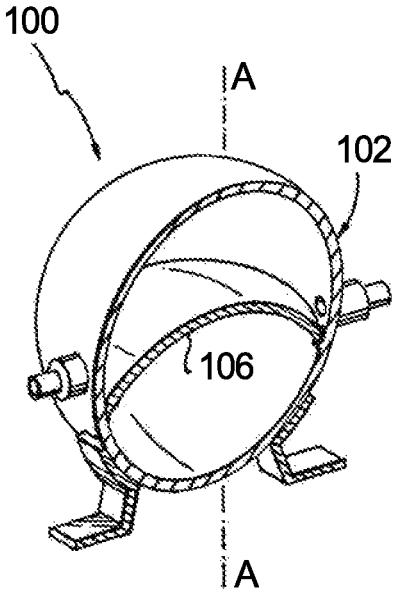
Fig. 2
Fig. 3
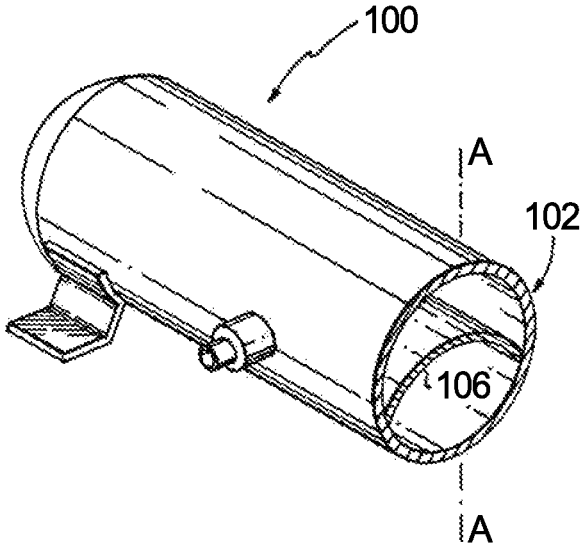

FIRE EXTINGUISHERS WITH INVERTED INTERNAL DOMES

BACKGROUND OF THE INVENTION

1. Field of the Invention

The present disclosure relates to fire extinguishers, and more particularly to fire extinguishers for aerospace applications.

2. Description of Related Art

Traditional aircraft fire extinguishers utilize a sphere filled with liquefied extinguishing agent that is expelled through a discharge head at or near the bottom of the spherical container. During discharge, the liquefied agent is driven down and out of the container by the combined agent vapor pressure and a super-pressurizing gas. These containers typically require customized brackets with supports or plates which interface with mounting lugs on the container, typically along the equator thereof. Designs which locate the discharge head outlets further up the side of the container limit the mass of the liquefied agent which is expelled. A dip-tube can be used to increase agent utilization for such designs. However, the dip-tubes present issues with respect to manufacturability and reliability.

The conventional techniques have been considered satisfactory for their intended purpose. However, there is an ever present need for improved fire extinguishers. This disclosure provides a solution for this problem.

SUMMARY OF THE INVENTION

A fire extinguisher includes a main dome partially surrounding an internal space housing agent. A secondary dome is mounted to the main dome and is inverted with respect to the main dome.

The secondary dome can have a radius of curvature that is equal to that of the main dome. The secondary dome can be welded to the main dome. The secondary dome and main dome can include stainless steel, aluminum, titanium or composites. The main dome and the secondary dome can be spherical. The main dome and the secondary dome can be cylindrical. A discharge outlet can be positioned closer to the secondary dome than to an apex of the main dome opposite the secondary dome. The discharge outlet can include a discharge outlet configured to discharge laterally relative to an axis of symmetry of the main dome and the secondary dome.

The main dome can circumferentially enclose the secondary dome, wherein the secondary dome divides the interior of the main dome into the internal space housing agent and an internal space free of agent. The internal space housing agent can be pressurized relative to the internal space free of agent. The internal space housing agent can be pressurized relative to ambient, and wherein the internal space free of agent is not pressurized relative to ambient. One or more mounting lugs can be mounted to the main dome opposite the internal space housing agent.

A support plate can be mounted opposite the main dome across the secondary dome. The internal space housing agent can be defined between the main dome and the secondary dome and can be pressurized relative to an internal space free of agent defined between the secondary dome and the support plate. The internal space housing agent can be pressurized relative to ambient, wherein the internal space free of agent is not pressurized relative to ambient. One or more mounting lugs can be mounted to the support plate.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIG. 1 is a schematic cross-sectional elevation view of an exemplary embodiment of a fire extinguisher constructed in accordance with the present disclosure, showing the inverted secondary dome within the main dome;

FIG. 2 is a partially cross-sectional perspective view of the fire extinguisher of FIG. 1, showing a spherical embodiment of the fire extinguisher with the cross-section shown in FIG. 1;

FIG. 3 is a cross-sectional perspective view of another exemplary embodiment of a fire extinguisher that is cylindrical with the cross-section shown in FIG. 1. (the cylinder can also be oriented vertically, e.g. as an elongated sphere relative to FIG. 1);

DETAILED DESCRIPTION OF THE PREFERRED EMBODIMENTS

Figure 4:
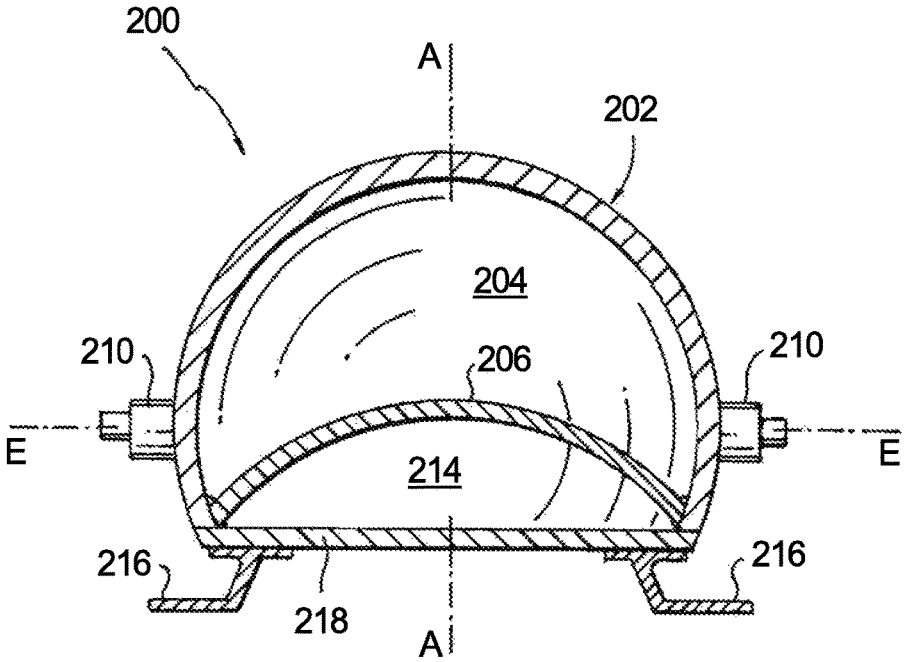
FIG. 4 is a schematic cross-sectional elevation view of another exemplary embodiment of a fire extinguisher constructed in accordance with the present disclosure, showing a support plate mounted below the inverted secondary dome.

Reference will now be made to the drawings wherein like reference numerals identify similar structural features or aspects of the subject disclosure. For purposes of explanation and illustration, and not limitation, a partial view of an exemplary embodiment of a fire extinguisher in accordance with the disclosure is shown in FIG. 1 and is designated generally by reference character 100. Other embodiments of fire extinguishers in accordance with the disclosure, or aspects thereof, are provided in FIGS. 2-6, as will be described. The systems and methods described herein can be used for fire extinguishing in aerospace applications, for example.

The fire extinguisher 100 includes a main dome 102 partially surrounding an internal space 104 housing fire extinguishing agent. A secondary dome 106 is mounted to the main dome 102, i.e. inside the interior of the main dome 102. The secondary dome 106 is inverted with respect to the main dome 102, i.e. the secondary dome is mounted in the bottom half of the secondary dome as oriented in FIG. 1, but has a convex curvature where the bottom half of the main dome 102 has a concave curvature. The secondary dome 106 has a radius of curvature R2 that is equal to the radius of curvature R1 of the main dome 102, however those skilled in the art will readily appreciate that the two radii R1 and R2 can be different from one another and/or individually variable without departing from the scope of this disclosure.

The secondary dome 106 is welded or otherwise sealed to the main dome 102 at a joint 108 that is at, below, or above the equator E of the main dome 102. The secondary dome 106 and main dome 102 can be made of stainless steel or any other suitable metal. In FIG. 2, the main dome 102 and the secondary dome 106 can be spherical based on the cross-section shown schematically in FIG. 1. It is also contemplated that the main dome 102 and the secondary dome 106 can be elongated vertically based on the cross-section shown schematically in FIG. 1 to be cylindrical. As shown in FIG. 3, it is also contemplated that the main dome 102 and the secondary dome 106 can be cylindrical based on the cross-section schematically shown in FIG. 1.

With reference again to FIG. 1, two discharge outlets 110 are positioned closer to the secondary dome 106 than to an apex 112 of the main dome 102 opposite the secondary dome 106. The discharge outlets 110 are configured to discharge laterally or near laterally relative to an axis of symmetry A of the main dome 102 and the secondary dome 106.

The main dome 102 circumferentially encloses the secondary dome 106, wherein the secondary dome 106 divides the interior of the main dome 102 into the internal space housing agent 104 and an internal space free of agent 114. The internal space housing agent 104 is pressurized relative to the internal space free of agent 114, which in turn can be unpressurized relative to ambient. With the discharge outlets 110 proximate the bottom of the internal space housing agent 104, all or almost all of the agent can be discharged through the outlets 110 even though the discharge outlets 110 are well above the bottom of the main dome 102 and do not require a dip-tube like conventional fire extinguishers. Although shown and described in the exemplary context showing two discharge outlets 110, those skilled in the art will readily appreciate that any suitable number of discharge outlets, including one, can be used without departing from the scope of this disclosure. One or more mounting lugs 116 are mounted to the main dome 102 opposite the internal space housing agent 104, so fire extinguisher 100 can readily be floor mounted.

Figure 5:
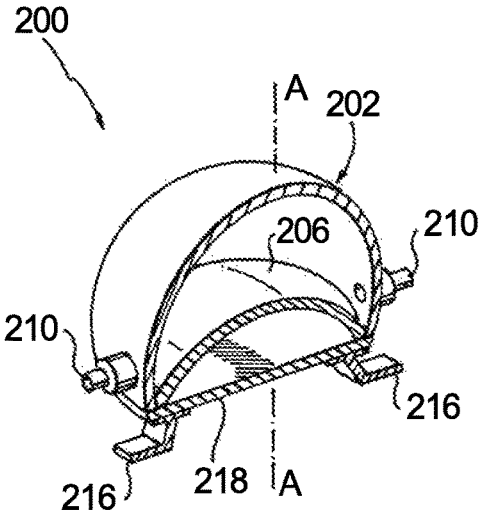
FIG. 5 is a partially cross-sectional perspective view of the fire extinguisher of FIG. 4, showing a spherical embodiment of the fire extinguisher with the cross-section shown in FIG. 4.
Figure 6:
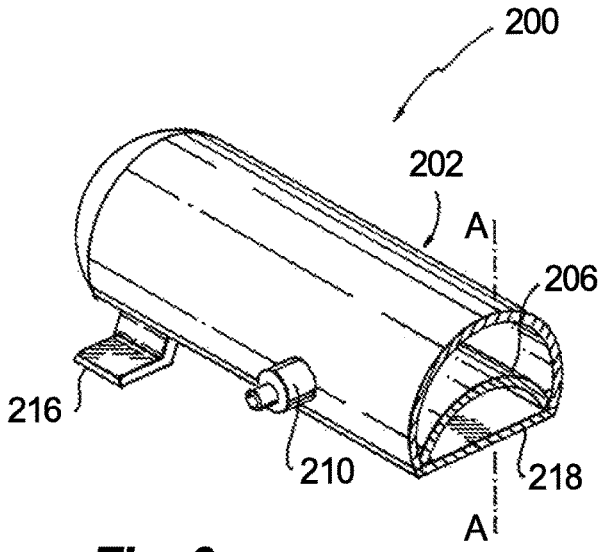
FIG. 6 is a cross-sectional perspective view of another exemplary embodiment of a fire extinguisher that is cylindrical with the cross-section shown in FIG. 4 (the cylinder can also be oriented vertically, e.g. as an elongated sphere relative to FIG. 4).

With reference now to FIG. 4, another exemplary embodiment of a fire extinguisher 200 is shown, having a main dome 202 and a secondary dome 206 similar to those described above with respect to FIG. 1. A support plate 218 is mounted opposite the main dome 202 across the secondary dome 206. The internal space housing agent 204 is defined between the main dome 202 and the secondary dome 206 and is pressurized relative to an internal space free of agent 214 defined between the secondary dome 206 and the support plate 218. The internal space housing agent 204 is pressurized relative to ambient, and the internal space free of agent 214 need not be pressurized relative to ambient as described above with respect to FIG. 1. One or more mounting lugs 216 are mounted to the support plate 218, e.g., for floor mounting. Like fire extinguisher 100, fire extinguisher 200 includes discharge outlets 210 that can discharge horizontally, or near horizontally, approximately along equator E, and can therefore use all or almost all agent housed in the internal space housing agent 204. Also as describe above with respect to FIGS. 1-3, fire extinguisher 200 can be spherical as shown in FIG. 5, or cylindrical as shown in FIG. 6, based on the cross-section shown schematically in FIG. 4 that is symmetrical across symmetry axis A. Support plate 218 and secondary dome 206 can be welded or otherwise sealed to main dome 202 along joint 208, and the support plate 218, main dome 202, and secondary dome 206 can all be made of stainless steel or any other suitable material.

Those skilled in the art will readily appreciate that the internal dome, e.g. secondary domes 106 or 206, can be configured such that the size, shape, thickness, and material properties provide the required strength to contain the pressurized agent.

The methods and systems of the present disclosure, as described above and shown in the drawings, provide for fire extinguishers with superior properties including mounting lugs that can be located near the bottom of the fire extinguisher, enabling mounting on a floor structure without additional support structures, while the relative position of the discharge outlets can maximize usage of the extinguishing agent. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A pressure vessel for a fire extinguisher comprising: A spherical main dome partially surrounding an internal space housing an agent; and a secondary dome mounted to the main dome that is inverted with respect to the main dome, wherein the internal space housing the agent is defined between the main dome and the secondary dome, wherein the secondary dome is mounted to a bottom half of the main dome and has a convex curvature where the bottom half of the main dome has a concave curvature, further comprising a discharge outlet connected to the internal space housing the agent for discharging the agent, wherein the discharge outlet is positioned closer to the secondary dome than to an apex of the main dome opposite the secondary dome, wherein the secondary dome is sealed to the main dome, wherein the main dome circumferentially encloses the secondary dome, wherein the secondary dome divides an interior of the main dome into the internal space housing the agent and an internal space free of the agent, wherein the secondary dome is welded to the main dome, wherein the internal space housing the agent is fluidly isolated from the internal space free of the agent, wherein the internal space free of the agent does not discharge any fluid.

2. A pressure vessel for a fire extinguisher as recited in claim 1, wherein the secondary dome has a radius of curvature that is equal to a radius of curvature of the main dome.

3. A pressure vessel for a fire extinguisher as recited in claim 1, wherein the secondary dome and main dome include at least one of stainless steel, aluminum, titanium or composites.

4. A pressure vessel for a fire extinguisher as recited in claim 1, wherein the discharge outlet includes a discharge opening configured to discharge laterally relative to an axis of symmetry of the main dome and the secondary dome.

5. A pressure vessel for a fire extinguisher as recited in claim 1, wherein the internal space housing the agent is pressurized relative to the internal space free of the agent.

6. A pressure vessel for a fire extinguisher as recited in claim 5, wherein the internal space housing the agent is pressurized relative to ambient.

7. A pressure vessel for a fire extinguisher as recited in claim 5, further comprising one or more mounting lugs mounted to the main dome opposite the internal space housing the agent.

8. A pressure vessel for a fire extinguisher as recited in claim 1, further comprising a support plate mounted opposite the main dome across the secondary dome.

9. A pressure vessel for a fire extinguisher as recited in claim 8, wherein the internal space housing the agent is pressurized relative to the internal space free of the agent defined between the secondary dome and the support plate.

10. A pressure vessel for a fire extinguisher as recited in claim 9, wherein the internal space housing the agent is pressurized relative to ambient.

11. A pressure vessel for a fire extinguisher as recited in claim 8, further comprising one or more mounting lugs mounted to the support plate.

12. A pressure vessel for a fire extinguisher comprising: A cylindrical main dome partially surrounding an internal space housing an agent; and a secondary dome mounted to the main dome that is inverted with respect to the main dome, wherein the internal space housing the agent is defined between the main dome and the secondary dome, wherein the secondary dome is mounted to a bottom half of the main dome and has a convex curvature where the bottom half of the main dome has a concave curvature, further comprising a discharge outlet connected to the internal space housing the agent for discharging the agent, wherein the discharge outlet is positioned closer to the secondary dome than to an apex of the main dome opposite the secondary dome, wherein the secondary dome is sealed to the main dome, wherein the main dome circumferentially encloses the secondary dome, wherein the secondary dome divides an interior of the main dome along an axial length of the main dome into the internal space housing the agent and an internal space free of the agent, wherein the secondary dome is welded to the main dome, wherein the internal space housing the agent is fluidly isolated from the internal space free of the agent, wherein the internal space free of the agent does not discharge any fluid.

13. A pressure vessel for a fire extinguisher as recited in claim 12, wherein the secondary dome has a radius of curvature that is equal to a radius of curvature of the main dome.

14. A pressure vessel for a fire extinguisher as recited in claim 12, wherein the discharge outlet includes a discharge opening configured to discharge laterally relative to an axis of symmetry of the main dome and the secondary dome.

15. A pressure vessel for a fire extinguisher as recited in claim 12, wherein the internal space housing the agent is pressurized relative to the internal space free of the agent.

16. A pressure vessel for a fire extinguisher as recited in claim 15, wherein the internal space housing the agent is pressurized relative to ambient.

17. A pressure vessel for a fire extinguisher comprising: a main dome partially surrounding an internal space housing an agent; and a secondary dome mounted to the main dome that is inverted with respect to the main dome, wherein the internal space housing the agent is defined between the main dome and the secondary dome, wherein the secondary dome is mounted to a bottom half of the main dome and has a convex curvature where the bottom half of the main dome has a concave curvature, further comprising a discharge outlet connected to the internal space housing the agent for discharging the agent, wherein the discharge outlet is positioned closer to the secondary dome than to an apex of the main dome opposite the secondary dome, wherein the secondary dome is sealed to the main dome, wherein the main dome circumferentially encloses the secondary dome, wherein the secondary dome divides an interior of the main dome into the internal space housing the agent and an internal space free of the agent, wherein the secondary dome is welded to the main dome, wherein the internal space housing the agent is fluidly isolated from the internal space free of the agent, wherein the internal space free of the agent does not discharge any fluid.

* * * * *